US010859004B2

(12) United States Patent
Shehan et al.

(10) Patent No.: US 10,859,004 B2
(45) Date of Patent: Dec. 8, 2020

(54) ELECTRONIC FUEL INJECTION THROTTLE BODY ASSEMBLY

(71) Applicant: Holley Performance Products, Inc., Bowling Green, KY (US)

(72) Inventors: Laura Shehan, Bowling Green, KY (US); Amy Gieske, Loogootee, IN (US); Jonathan Sams, Woodburn, KY (US); Adam Layman, Alvaton, KY (US)

(73) Assignee: Holley Performance Products, Inc., Bowling Green, KY (US)

( * ) Notice: Subject to any disclaimer, the term of this patent is extended or adjusted under 35 U.S.C. 154(b) by 0 days.

(21) Appl. No.: 16/208,231

(22) Filed: Dec. 3, 2018

(65) Prior Publication Data

US 2019/0170070 A1 Jun. 6, 2019

Related U.S. Application Data

(60) Provisional application No. 62/594,526, filed on Dec. 4, 2017.

(51) Int. Cl.
*F02M 51/06* (2006.01)
*F02D 9/10* (2006.01)
(Continued)

(52) U.S. Cl.
CPC ..... *F02D 9/105* (2013.01); *F02D 9/1035* (2013.01); *F02M 35/10216* (2013.01);
(Continued)

(58) Field of Classification Search
CPC ..... F02D 9/105; F02D 9/1035; F02D 9/02; F02D 9/107; F02M 69/043; F02M 69/042;
(Continued)

(56) References Cited

U.S. PATENT DOCUMENTS 4,224,908 A 9/1980 Bier et al.
4,230,645 A 10/1980 Dodson
(Continued)

FOREIGN PATENT DOCUMENTS

AU 339157 10/2011
AU 341133 2/2012
(Continued)

OTHER PUBLICATIONS

U.S. Appl. No. 29/628,392 entitled "EFI Throttle Body" filed Dec. 4, 2017.
(Continued)

*Primary Examiner* — Hai H Huynh
(74) *Attorney, Agent, or Firm* — Middleton Reutlinger

(57) ABSTRACT

Present embodiments provide an electronic fuel injection throttle body which may be used with a variety of engines of different manufacturers. The throttle body may be used to replace mechanical or hydraulically controlled carburetors with electronic fuel injection. The bores or barrels of the throttle body may comprise one or more stackable fuel injectors. The fuel component cover may include a regulator with a housing for integrally with the fuel component cover or alternatively, a regulator may be located remotely.

20 Claims, 13 Drawing Sheets

(51) Int. Cl.
*F02M 61/18* (2006.01)
*F02M 35/10* (2006.01)
*F02M 69/04* (2006.01)
*F02D 9/02* (2006.01)

(52) U.S. Cl.
CPC ..... *F02M 61/18* (2013.01); *F02M 69/042* (2013.01); *F02M 69/043* (2013.01); *F02D 9/02* (2013.01); *F02D 9/107* (2013.01)

(58) Field of Classification Search
CPC ... F02M 61/18; F02M 35/10216; F02M 69/04
USPC ..... 123/470, 336, 337
See application file for complete search history.

(56) References Cited

U.S. PATENT DOCUMENTS 4,246,875 A 1/1981 Bier et al.
4,294,282 A 10/1981 McCabe et al.
4,306,441 A 12/1981 Dodson
4,318,214 A 3/1982 Dodson
4,325,339 A 4/1982 Bier et al.
4,357,283 A 11/1982 Manning
4,434,762 A 3/1984 McCabe
4,434,763 A 3/1984 McCabe et al.
4,556,032 A 12/1985 Miller
4,817,570 A * 4/1989 Morita ..... F02D 41/0085 123/472
4,949,983 A 8/1990 Miller
5,261,382 A 11/1993 Nikolai
5,809,972 A * 9/1998 Grant ..... F02M 71/00 123/472
6,120,007 A * 9/2000 Grant ..... F02M 9/14 261/23.2
D447,147 S 8/2001 Grant
6,481,698 B1 11/2002 Calvin et al.
D508,496 S 8/2005 Grant
D543,555 S 5/2007 Braswell et al.
D555,668 S 11/2007 Benoit
D578,550 S 10/2008 Benoit
7,533,661 B2 5/2009 Baasch
7,591,245 B2 9/2009 Baasch et al.
D645,058 S 9/2011 Benoit
D648,746 S 11/2011 Tipton et al.
D655,311 S 3/2012 Gieske et al.
D659,714 S 5/2012 Gieske et al.
D721,389 S 1/2015 Gieske et al.
9,115,671 B2 8/2015 Benoit
9,303,578 B2 4/2016 Wittkopf et al.
9,376,997 B1 * 6/2016 Farrell ..... F02M 69/52
D760,804 S 7/2016 Shehan et al.
9,482,198 B1 11/2016 Farrell et al.
9,845,740 B2 12/2017 Wittkopf et al.
D808,435 S 1/2018 Shehan et al.
D810,142 S 2/2018 Shehan et al.
10,012,197 B2 7/2018 Flynn et al.
D826,280 S 8/2018 Koo et al.
10,094,353 B2 10/2018 Bennett et al.
10,294,902 B2 5/2019 Shehan et al.
2005/0110170 A1 * 5/2005 Grant ..... F02M 7/00 261/23.2
2005/0229902 A1 * 10/2005 Taguchi ..... F02D 9/1095 123/336
2006/0225708 A1 * 10/2006 Taguchi ..... F02M 55/025 123/468
2008/0230034 A1 9/2008 Dunn
2009/0013955 A1 1/2009 Sheridan et al.
2009/0107459 A1 * 4/2009 Ross, Jr. ..... F02M 19/03 123/437
2009/0145406 A1 * 6/2009 Farrell ..... F02M 35/10032 123/470
2009/0277432 A1 * 11/2009 Hung ..... F02B 17/005 123/575
2011/0095215 A1 * 4/2011 Larsson ..... F02D 9/105 251/129.01
2011/0108003 A1 * 5/2011 Kimura ..... F02M 35/10216 123/456
2013/0054121 A1 2/2013 Casoni et al.
2013/0081595 A1 * 4/2013 Yokotani ..... F02F 1/242 123/337
2013/0133617 A1 * 5/2013 Machida ..... F02D 9/109 123/336
2013/0298868 A1 * 11/2013 Wittkopf ..... F02D 41/08 123/339.14
2013/0298871 A1 * 11/2013 Bennett ..... F02M 35/10216 123/445
2015/0108256 A1 * 4/2015 Flynn ..... F02M 61/184 239/562
2017/0198672 A1 7/2017 Farrell et al.
2018/0119656 A1 * 5/2018 Shehan ..... F02D 41/30
2019/0170069 A1 6/2019 Shehan et al.
2019/0170070 A1 6/2019 Shehan et al.

FOREIGN PATENT DOCUMENTS

AU 348732 5/2013
AU 348733 5/2013
AU 348734 5/2013
AU 356762 8/2014
AU 201710470 2/2017
AU 201710471 2/2017
AU 2013254906 11/2017
AU 201813353 8/2018
AU 201813355 8/2018
AU 201815034 9/2018
AU 201815036 9/2018
AU 201816623 12/2018
AU 201816624 12/2018
CN 101568711 4/2013
EM 003729599 1/2017

OTHER PUBLICATIONS

Holley Performance Products, Inc., 2017 New & Hot Products Catalogue—Carburetors, Nov. 1, 2016.
U.S. Appl. No. 62/594,526 entitled "Electronic Fuel Injection Throttle Body Assembly" filed Dec. 4, 2017.
Australian Patent Application No. 2017251869 entitled "Electronic Fuel Injection Throttle Body Assembly" filed Oct. 30, 2017.
U.S. Appl. No. 62/594,527 entitled "Electronic Fuel Injection Throttle Body Assembly" filed Dec. 4, 2017.
U.S. Appl. No. 29/628,394 entitled "EFI Throttle Body" filed Dec. 4, 2017.
U.S. Appl. No. 62/669,052 entitled "Electronic Fuel Injection Throttle Body Assembly" filed May 9, 2018.
U.S. Appl. No. 15/986,571 entitled "Fuel Injection Throttle Body" filed May 22, 2018.
U.S. Appl. No. 29/688,819 entitled "Electronic Fuel Injection Throttle Body" filed Apr. 24, 2019.
U.S. Appl. No. 29/647,060 entitled "Electronic Fuel Injection Throttle Body" filed May 9, 2018.
U.S. Appl. No. 62/669,094 entitled "Electronic Fuel Injection Throttle Body Assembly" filed May 9, 2018.
U.S. Appl. No. 62/726,723 entitled "Electronic Fuel Injection Throttle Body Assembly" filed Sep. 4, 2018.
Mopar Performance P5249686 Jeep MPI-Fuel, Sep. 2, 2016.
Howell EFI Fuel Injection Conversion Kit, JP258, Apr. 29, 2015.
F.A.S.T. EZ-EFI Self-Tuning Fuel Injection Systems 30294-Kit TBI Converstion Kit, Jun. 30, 2015.
U.S. Appl. No. 29/693,670 entitled "Electronic Fuel Injection Throttle Body Assembly" filed Jun. 4, 2019.
International Search Report and Written Opinion for PCT/US2018/063660 dated Mar. 20, 2019.
International Search Report and Written Opinion for PCT/US2018/063668 dated Mar. 20, 2019.
Canadian Design Patent Application No. 184483 entitled "Electronic Fuel Injection Throttle Body" filed Oct. 31, 2018.
Canadian Design Patent Application No. 184482 entitled "Electronic Fuel Injection Throttle Body" filed Oct. 31, 2018.

(56) References Cited

OTHER PUBLICATIONS

Mexican Design Patent Application No. MX/f/2018/003332 entitled "Electronic Fuel Injection Throttle Body" filed Nov. 8, 2018.
Mexican Design Patent Application No. MX/f/2018/003333 entitled "Electronic Fuel Injection Throttle Body" filed Nov. 8, 2018.
U.S. Appl. No. 29/647,068 entitled "Electronic Fuel Injection Throttle Body" filed May 9, 2018.
U.S. Appl. No. 16/389,227 entitled "Electronic Fuel Injection Throttle Body Assembly" filed Apr. 19, 2019.
U.S. Appl. No. 16/405,519 entitled "Electronic Fuel Injection Throttle Body Assembly" filed May 7, 2019.
U.S. Appl. No. 16/404,308 entitled "Electronic Fuel Injection Throttle Body Assembly" filed May 6, 2019.
International Search Report and Written Opinion for PCT/US2019/030909 dated Aug. 20, 2019.
International Search Report and Written Opinion for PCT/US2019/031138 dated Aug. 27, 2019.
Youtube video, "Holley Terminator EFI Kit Electronic Fuel Injection", May 6, 2015. Retrieved from https://www.youtube.com/watch?v=hrTppUkNAn0; retrieved on Jul. 1, 2019.
The International Bureau of WIPO, International Preliminary Report on Patentability for PCT/US2018/063600, 10 pages, dated Jun. 9, 2020.
Australian Patent Application No. 2018378313 as filed entitled "Electronic Fuel Injection Throttle Body Assembly" entered national stage on Jun. 26, 2020.

* cited by examiner

ELECTRONIC FUEL INJECTION THROTTLE BODY ASSEMBLY

CLAIM TO PRIORITY

This non-provisional patent application claims priority to and benefit of, under 35 U.S.C. § 119(e), U.S. Provisional Patent Application Ser. No. 62/594,526, filed Dec. 4, 2017 and titled "Electronic Fuel Injection Throttle Body Assembly", all of which is incorporated by reference herein.

BACKGROUND

Field of the Invention

Present embodiments related to throttle body fuel injection systems intended to replace existing carburetors. More specifically, present embodiments relate to retrofitting carbureted engines with electronic fuel injection (EFI) which may be mounted on a manifold of an internal combustion engine and have numerous features including small size, improved performance, ease of installation and the like.

Description of the Related Art

Replacement throttle body systems are utilized to provide carburetor replacement while having improved performance of electronic fuel injection. This is desirable for higher performance engines or improving performance and consistency of older engines.

However, when installing these systems, there are multiple variables related to size of throttle body, space on the engine and relative to the vehicle hood, space relative to surrounding engine components.

Prior art devices are often fully mechanical or hydraulic which over time can lead to decrease in proper function. Further, variations in atmospheric temperature and pressure, engine temperature, load and speed are all variable rendering difficult to maximize efficiency and/or performance of prior art carburation. For example, cold engine condition, an engine at idle, and an engine at wide-open throttle all require a rich fuel-air mixture. However, warm engine at cruise requires a lean fuel-air mixture. The airflow also varies greatly, as much as 100 times, between wide-open throttle and idle condition. Still another variable may be fuel formulations and characteristics.

It would be desirable to improve consistency of operation with an engine throttle body to improve carburation while also improving performance and/or efficiency.

It would also be desirable to provide a throttle body which may be used with a variety of engine manufacturers and fit within engine compartments of a variety of vehicles.

Additionally, it may be desirable to provide a retrofit structure which will fit in the general envelope or boundary of the previously existing carburetor that is being retrofitted.

The information included in this Background section of the specification, including any references cited herein and any description or discussion thereof, is included for technical reference purposes only and is not to be regarded subject matter by which the scope of the invention is to be bound.

SUMMARY

Embodiments relate to carburetor retrofit fuel injection systems.

Present embodiments provide a throttle body assembly which may be used with a variety of engines of different manufacturers. The throttle body assembly may be used to replace mechanical or hydraulically controlled carburetors with electronic fuel injection. The throttle body assembly may provide improved fuel pathways through and about the throttle body in order to move fuel. The throttle bodies may have improved configuration of the fuel injectors. Further, the throttle body may have computer mounted on the throttle body and a notch formed in the throttle body to define a wire routing pathway from the computer to the injectors.

It should be appreciated that the fuel injection system may include a main throttle body and one or more fuel component covers. These fuel component covers may be oriented on the right and left sides of the main body, the front and back sides, or in any other configuration. The fuel component covers may be fluidly coupled by an external fuel crossover tube or conduit. An external fuel crossover tube or conduit may provide flexibility in fuel routing, alleviate some potential packaging issues, avoid possible casting issues such as porosity, and is serviceable.

The system may also be scalable as to the number of stacked fuel injectors based on the engine performance requirements.

According to some embodiments, a throttle body assembly comprises a body having a first bore and a second bore extending downwardly on a side of a body centerline, a fuel component cover having an inlet, the inlet disposed at an angle to a horizontal, the body having at least a first fuel injector port formed at each of the bores, the body having at least a second fuel injector port cast at each of said bores and configured for machining to render the retaining area usable, the fuel component cover disposed over the first fuel injector port and the second fuel injector port, a valve plate disposed within each of the bores, the valve plates disposed on a throttle shaft, the first and second fuel injectors having an alignment direction which is substantially perpendicular to the throttle shaft.

According to some optional embodiments, the various following features may be used with the throttle body assembly alone with the first embodiment or in combination with one another and the first embodiment. The throttle assembly may further comprise the throttle shaft extending through the body in a direction substantially perpendicular to a horizontal direction of the first fuel injector ports. The throttle body assembly may further comprise a fuel injector in each of the fuel injector ports. The throttle body assembly may further comprising a fuel regulator disposed on the fuel component cover. The throttle body assembly may further comprise an outlet in fluid communication with the fuel regulator. The outlet being angled relative to a horizontal direction. The fuel component cover may have parallel horizontal passages which are one of vertically aligned or offset. The throttle body assembly may further comprise a fuel outlet on the fuel component cover. The throttle body assembly may further comprise a regulator housing formed with said fuel component cover. The regulator cover may be clockably connected to the fuel component cover.

According to a further embodiment, a throttle body assembly may comprise a body having a first bore and a second bore extending downwardly on a side of a body centerline, at least one first fuel injector port formed at each of said bores, at least one second fuel injector retaining area formed in each of the bores, a fuel component cover having an inlet passage in flow communication, a vertical passage allowing flow communication to a second passage, the second passage capable of providing fuel flow to the second fuel injector retaining areas when configured for use, a valve plate disposed in each bore, a throttle shaft extending through the body and engaging the valve plates, the throttle shaft extending in a direction which is substantially perpendicular to a fuel injector horizontal direction.

According to some optional embodiments, the following features may be used alone with the previous embodiments, or in combination with the previous embodiments. The throttle body assembly may further comprise an electronic control unit disposed on a side of the body opposite the fuel component cover. The throttle body assembly may further comprise a plurality of strain reliefs along a lower edge of an electronic control unit cover. The throttle body assembly may further comprising a fuel outlet. The throttle body assembly may further comprise a fuel inlet and fuel outlet which may both be disposed on a single side of the body. The fuel injector opening may be angled relative to a horizontal. The fuel flow may enter the throttle component cover at an angle to a horizontal direction and travels in a horizontal direction. The fuel may flow in one of a vertical or an angled direction through the first body to change elevation.

All of the above outlined features are to be understood as exemplary only and many more features and objectives of a throttle body fuel injection system or assembly may be gleaned from the disclosure herein. Therefore, no limiting interpretation of this summary is to be understood without further reading of the entire specification, claims and drawings, included herewith.

BRIEF DESCRIPTION OF THE DRAWINGS

In order that the embodiments may be better understood, embodiments of the throttle body fuel injection system will now be described by way of examples. These embodiments are not to limit the scope of the claims as other embodiments of the throttle body fuel injection system will become apparent to one having ordinary skill in the art upon reading the instant description. Non-limiting examples of the present embodiments are shown in figures wherein:

DETAILED DESCRIPTION

Figure 1:
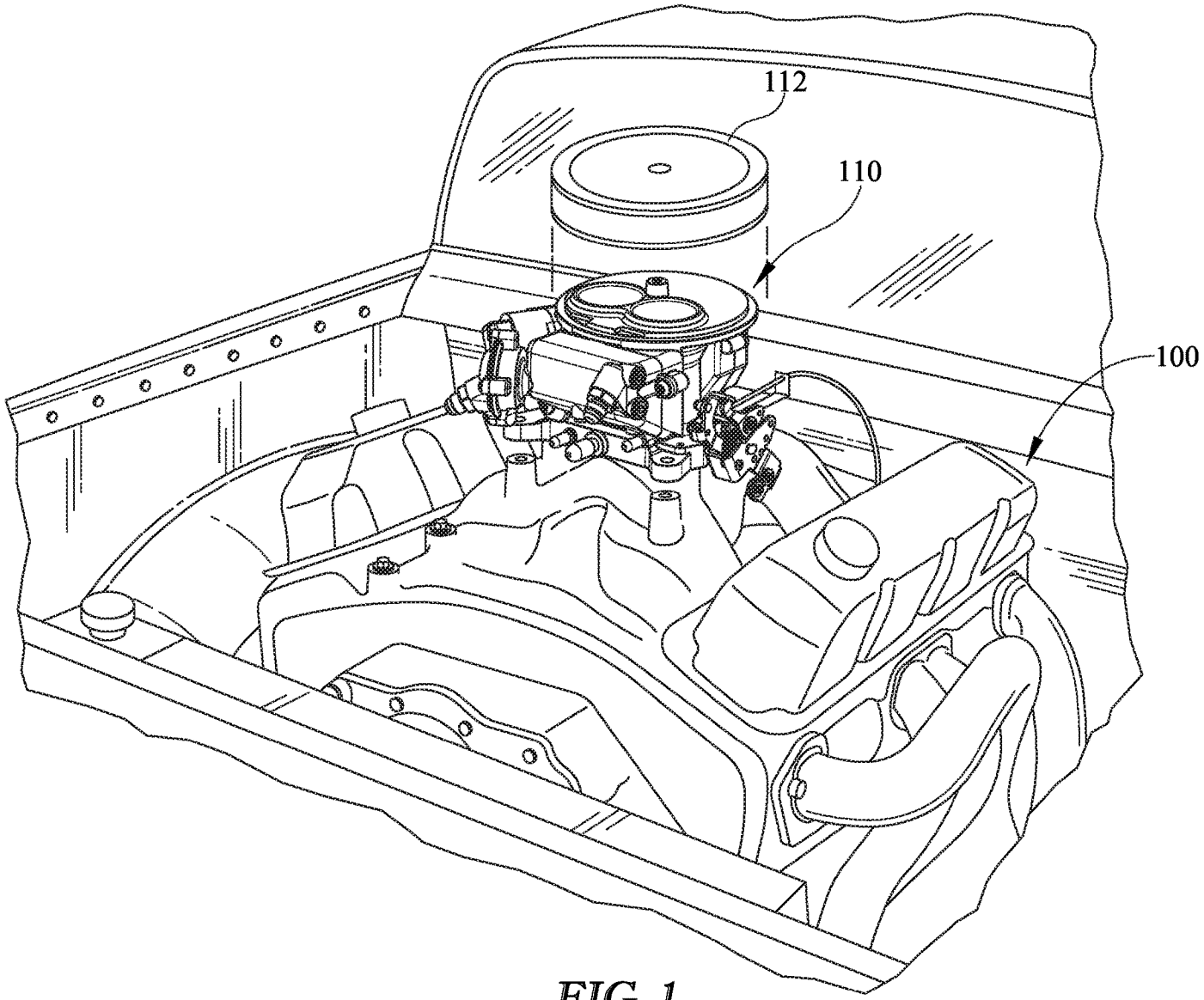
FIG. 1 is an upper perspective view of a combustion engine and an electronic fuel injection throttle body assembly.

It is to be understood that the electronic fuel injection throttle body assembly is not limited in its application to the details of construction and the arrangement of components set forth in the following description or illustrated in the drawings. The throttle body assembly is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now in detail to the drawings, wherein like numerals indicate like elements throughout several views, there are shown in FIGS. 1-13 various embodiments of a throttle body fuel injection system. Present embodiments pertain to an electronic fuel injection throttle body assembly which may be used to retrofit older throttle body assemblies.

With reference to FIG. 1, a partial perspective view of an engine compartment is depicted wherein a combustion engine 100 is provided with an electronic fuel injection (EFI) throttle body assembly 110 and an air filter 112. The engine is illustrative as one or more throttle body assemblies 110 may be utilized and one or more filter configurations may be used to deliver air to the one or more throttle body assemblies 110. The combustion process, as one of skill in the art will be aware, combines fuel and air with an ignition source. The instant throttle body assembly 110 is mounted to the engine 100 directly such as at the manifold and receives air through the air filter 112 and receives fuel from a fuel tank and mixes the two for the ignition which occurs in the engine 100. In other embodiments, the assembly 110 may be mounted to the engine indirectly such as to an adapter or a supercharger. In embodiments where more than one electronic fuel injection throttle body is utilized, the throttle body assembly 110 may be rotated about a vertical axis in order to arrange the assemblies 110 in a manner which fits or aligns appropriately with the engine manifold. Thus while terms such as front, rear and side may be utilized to describe the throttle body assembly 110, these terms are merely descriptive and illustrative, but should not be considered limiting.

The EFI throttle body assembly 110 is configured to be compact allowing use in a variety of configurations. Due to the wide variety of engine manufacturers and vehicle types and sizes, it is desirable to provide a structure which may be used in many of these vehicles/engines. This also requires consideration of space relative to the engine hood and space relative to surrounding engine components. It may also be desirable to provide a device of minimal height, for example less than 4 inches, a forward to rear length of less than about 10 inches and a side to side length of less than 10 inches. These dimensions are merely illustrative of a non-limiting embodiment, but provide a compact design desirable for use across many engine sizes and vehicle types.

Figure 2:
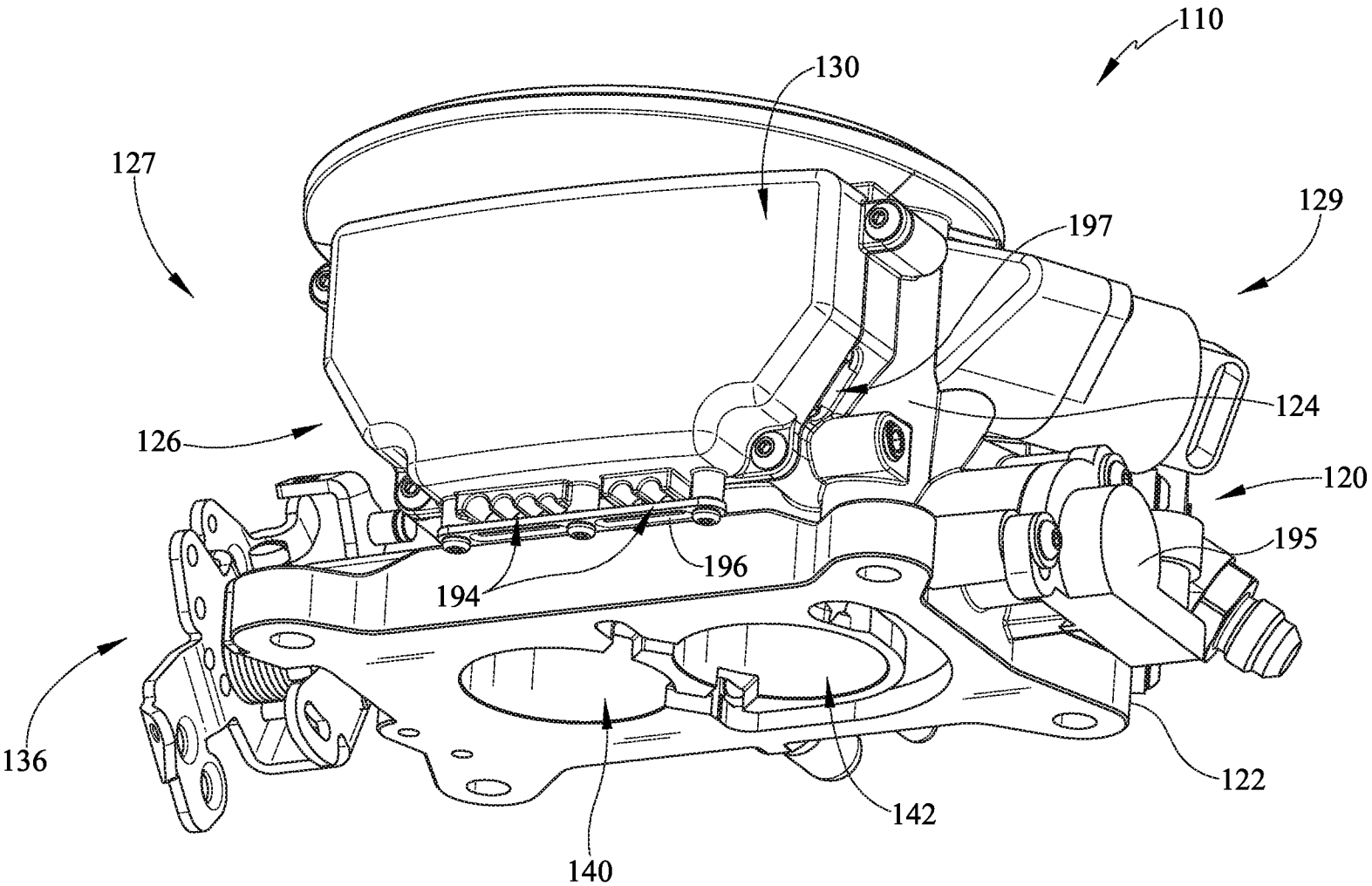
FIG. 2 is a rear perspective view of the electronic fuel injection throttle body assembly.
Figure 3:
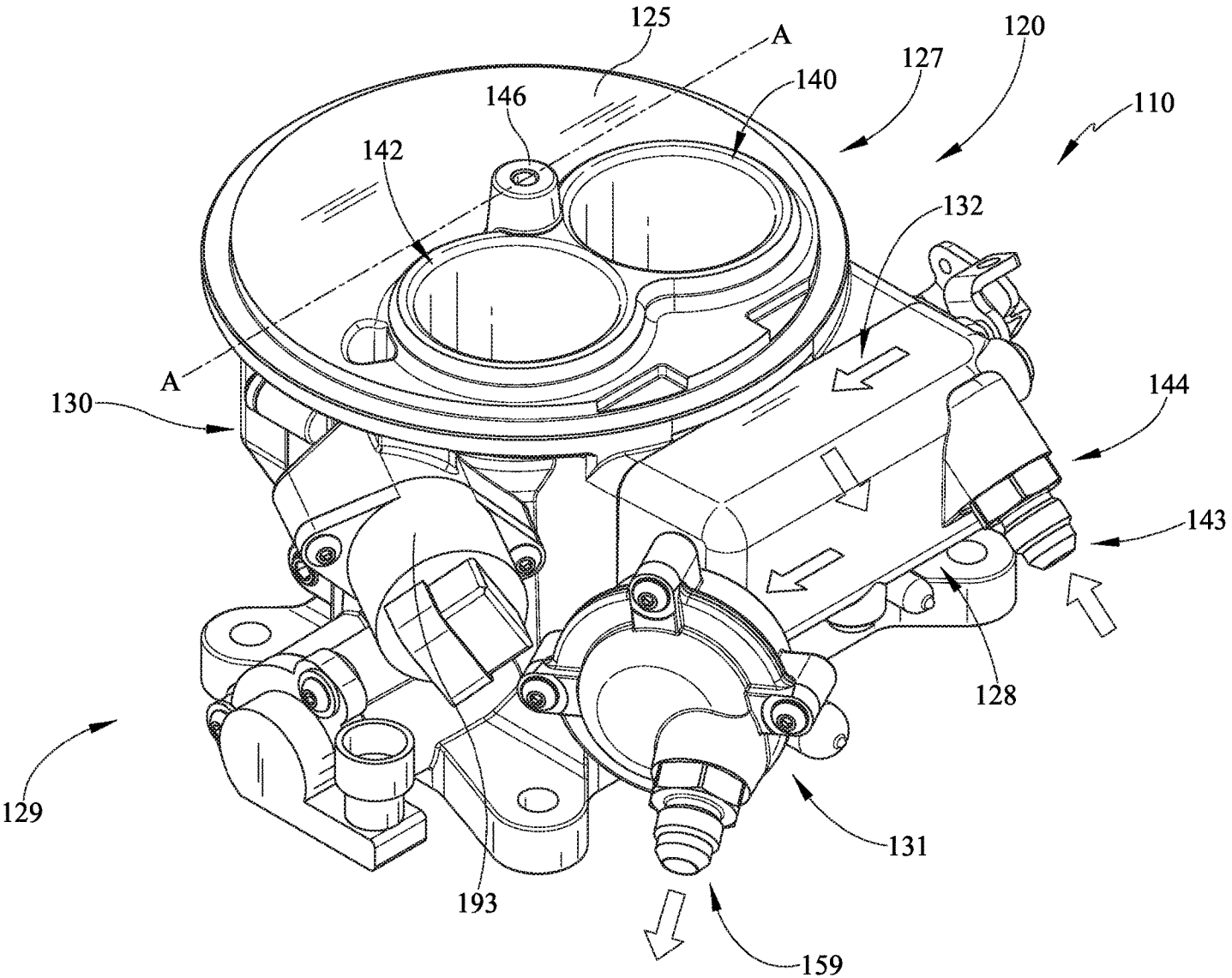
FIG. 3 is an upper front perspective view of the electronic fuel injection throttle body assembly removed from the engine.

With reference to FIG. 2, a rear perspective view of the carburetor is shown. The throttle body assembly 110 includes a throttle body 120 including a mounting base 122 and a main body 124 which extends upwardly from the base 122. As shown in FIG. 1, a filter 112 may be positioned on an upper surface of the throttle body assembly 110. Fuel is also provided to the throttle body assembly 110 and moves through the main body 124 before being introduced to the airflow moving into the throttle body assembly 110. A stand 146 (FIG. 3) is provided between the bores 140, 142 which supports a fastener (not shown) extending through the throttle body 120. The fastener extends up for engagement and connection of the air filter 112 (FIG. 1). The upper end of the main body 124 may include an upper flange 125 (FIG. 3). This flange 125 may define a seat or upper limit for positioning of air intake structure above the throttle body assembly 110. The base 122 may have a plurality of holes for mounting the assembly 110 wherein the multiple holes provide various known bolt patterns. The base 122 may also include various pipe ports where, for example some vehicle engines require vacuum ports. For example, a manifold vacuum port, distributor spark and others may be provided along, or near the base 122 or on the throttle body 124. The ports may be plugged at time of manufacture and unplugged by the end user to make these ports functional.

As shown in the view of FIG. 2, the throttle body assembly 110 may include two bores 140, 142. At the lower ends of the bores 140, 142, fuel and air are provided to the engine or a supercharger.

The depicted embodiment shows a two-bore throttle body assembly 110. The term "bore(s)" and "barrel(s)" may be used interchangeably throughout this description. The bores 140, 142 extend vertically through the throttle body 120. Additionally, more than one throttle body assembly 110 may be used in the engine depending on the engine type and configuration of intakes, thus increasing the air and fuel delivery capacity by way of these bores 140, 142 to an engine.

Figure 9:
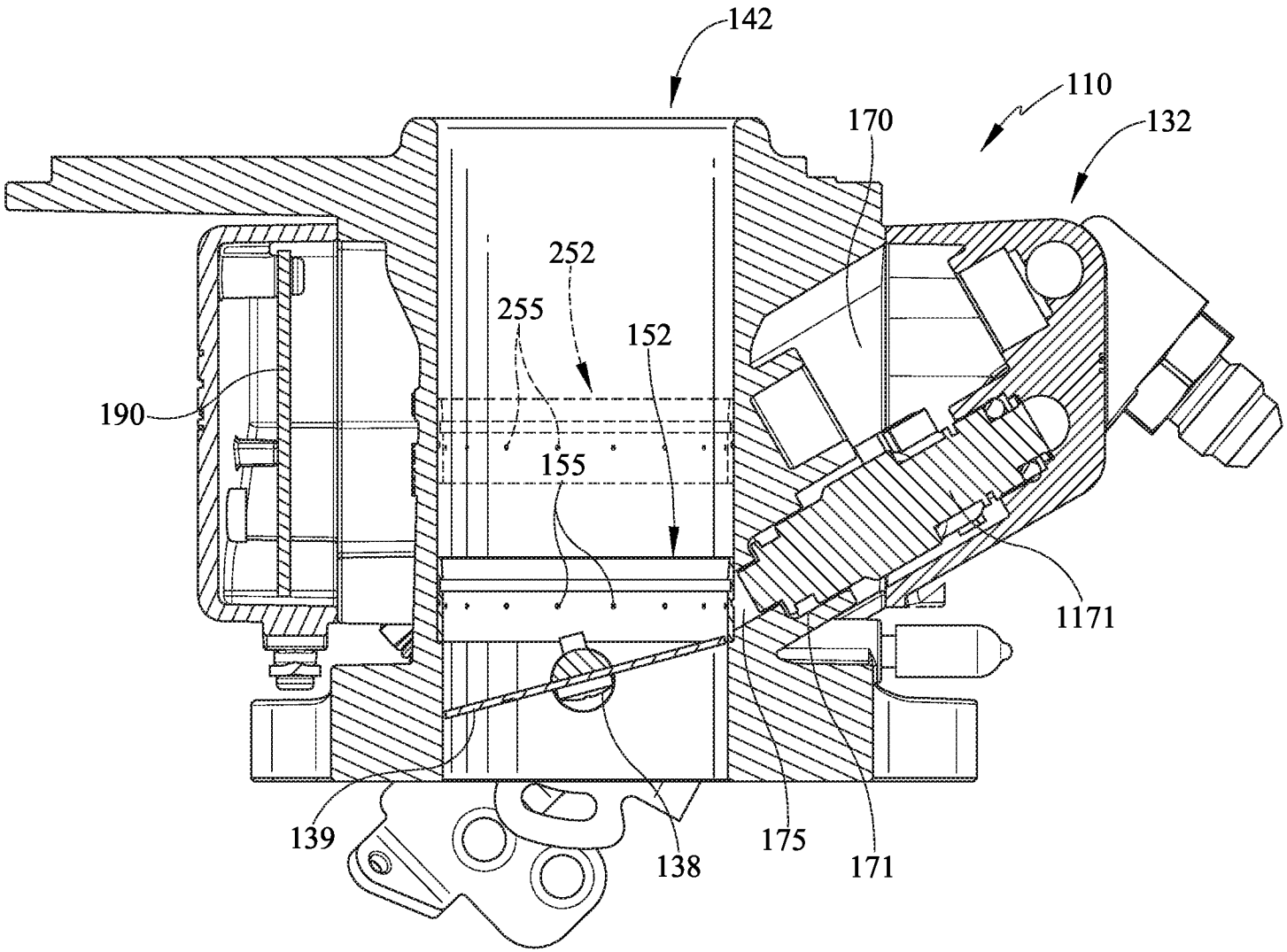
FIG. 9 is a side sectional view of the throttle body assembly depicting a ring which is inserted into the bore of the throttle body, according to the embodiment of FIG. 8.

The rear of the throttle body assembly 110 is shown in the instant view. For purpose of reference of description, but not limiting, the rear 126 of the throttle body assembly 110 is shown and the front 128 is shown in FIG. 3. Also shown in this view is an electronic control unit (ECU) cover 130 which conceals an electronic control unit (ECU) 190 (FIG. 9). The cover 130 may be bolted to the throttle body 120 or otherwise fastened thereto. Extending from the ECU cover 130 are a plurality of strain reliefs 194. According to some embodiments, the strain reliefs 194 may be positioned along a lower edge of the cover 130. In other embodiments however, the strain reliefs 194 may be located in other locations. The strain reliefs 194 may be all together or may be spaced apart individually or in groups. Also, the strain reliefs 194 may be of the same size or may be of varying size.

As will be described further herein, the cover 130 conceals and contains the electronic control unit 190. This control unit 190 may be mounted to the throttle body 120 or within the cover 130, or a combination thereof.

The throttle body 120 also comprises sides 127, 129 which are labeled for ease of reference in description. On the side 127, a throttle lever assembly 136 is shown. The throttle lever 136 receives driver input related to gas delivery to the engine and moves to either increase or decrease fuel and air flow to the engine.

Referring now to FIG. 3, an upper front perspective view of the electronic fuel injection throttle body assembly 110 is shown. In this view, the upper portion of the assembly 110 is shown for description.

An upper flange 125 is shown for positioning of an air filter 112 (FIG. 1). The flange 125 is shown as circular but may be other shapes depending on how the filter is arranged. The flange 125 also comprises a stand 146 through which a fastener may extend to connect a filter housing.

Also shown on the flange 125 are the bores 140, 142. The bores 140, 142 are not centrally located on the flange 125. Instead, the bores 140, 142 are disposed on one side of axis A-A. In the instant arrangement, the bores 140, 142 are disposed on toward the front side of the flange 125. These bores 140, 142 may also be in other configurations however, as the bore position may be varied depending on the size of the flange and the relationship to the lower portion of the throttle main body 124 (FIG. 2).

Also visible in this front perspective view, is a fuel component cover 132. The fuel component cover 132 includes fuel components and also functions as a cover 132. The fuel component cover 132 is mounted on one side of the throttle body 120, in this instance the front, but may also be disposed on other sides of the throttle body 120. The fuel component cover 132 comprises the fuel passageways therein and provides a cover for fuel delivery. The fuel component cover 132 is fastened to the throttle body 120 by two or more fasteners which are located at opposite ends of the fuel component cover 132. Further, the fasteners may be offset in elevation to improve attachment of the fuel component cover 132.

In addition to the fuel passage componentry in the component cover 132, the structures also cover fuel injectors 1170-1173 (FIG. 8) and mounted therein and extending into the throttle body 120. The fuel component cover 132 with fuel injectors 1170 positioned therein, is disposed on a side of the throttle body assembly 120 opposite the electronic control unit cover 130. With the electronic control unit cover 130 positioned opposite from to the component cover 132, the wire extending between the electronic control unit 190 (FIG. 9) and any of the fuel injectors 1170-1173 may be routed around the throttle body 120. It may be desirable to extend the wiring on a side of the throttle body away from the throttle lever assembly 136, which has moving parts. Therefore in some embodiments, the wires may be located along side 129. This is desirable for clean appearance and installation as well as inhibiting damage to the wiring, which controls function of the throttle body assembly 110.

Also shown in FIG. 3 is a fuel inlet 144 located on the fuel component cover 132. The fuel inlet 144 may comprise a fitting 143, to which a fuel conduit may be connected. The fitting 143 may be a standard fitting such as an SAE or similar automotive fitting for ease of use and/or replacement.

The flow path is shown by way of large arrows. The fuel inlet 144 provides fuel to passages 160, 164 (FIGS. 5, 6) formed in the interior of the fuel component cover 132. Within the cover 132 is an upper passageway 160 (FIG. 5) and a lower passageway 164 (FIG. 6), both of which are substantially horizontal. Also within the cover 132 is a vertical passage 162, or an angled passageway which moves from the upper passageway 160 to the lower passageway 164. In the instant embodiment, the internal connecting passage 162 is substantially vertical but the passage need not be solely vertical as the path may also be angled or curved and changing elevation. The internal connecting passage 162 may serve to equalize system pressure, or if a single fuel supply is used for the system, the internal connecting passage may distribute fuel. The passages 160, 164 provide fuel to the fuel injectors, at least one per bore 140, 142, which are covered by the fuel component cover 132.

In fluid communication with the lower passageway is a pressure regulator cover 131, wherein a regulator 134 (FIG. 6) is provided to return fuel flow to a fuel tank, when pressure reaches a preselected value. The regulator cover 131 is shown connected to a portion of the fuel component cover 132. The regulator cover 131 provides for a fuel outlet or port 159 which serves as a fuel outlet and through which fuel returns to a fuel tank of the vehicle. The regulator cover 131 includes a port 159 which also serves as a fuel outlet. The two horizontal passages are utilized where there are two fuel injectors per bore 140, 142. However, in some embodiments, there may be a single fuel injector per bore, in which case, both passages may not be necessary.

In some embodiments, the regulator cover 131 may be utilized to house the regulator. The regulator may or may not require any vacuum connection for operation. The regulator is fully encapsulated by the fuel component cover 132 which protects the regulator but also provides for ease of installation and manufacturing. When the fuel component cover 132 is installed, the regulator 154 is in place and ready for connection with return line to the fuel tank.

One skilled in the art will appreciate that the regulator may have one or more parts that open and close flow to the port 159, based on pressure within the fuel passages of the throttle body assembly 110.

In this view, the port 159 may be positioned off-center relative to the regulator cover 131. The cover 131 may be clockable, or rotatable, in 90 degrees, or other increments to rotate the position of the port 159. The cover 131 may comprise one or more fasteners 165 which may be removed and reinstalled to rotate the cover 131 into a position wherein the port 159 does not interfere with other parts. Thus, depending on the surrounding equipment in the engine, the port 159 position may be altered so as to limit interference or otherwise increase clearance relative to either or both of the engine compartment or other engine components.

Figure 4:
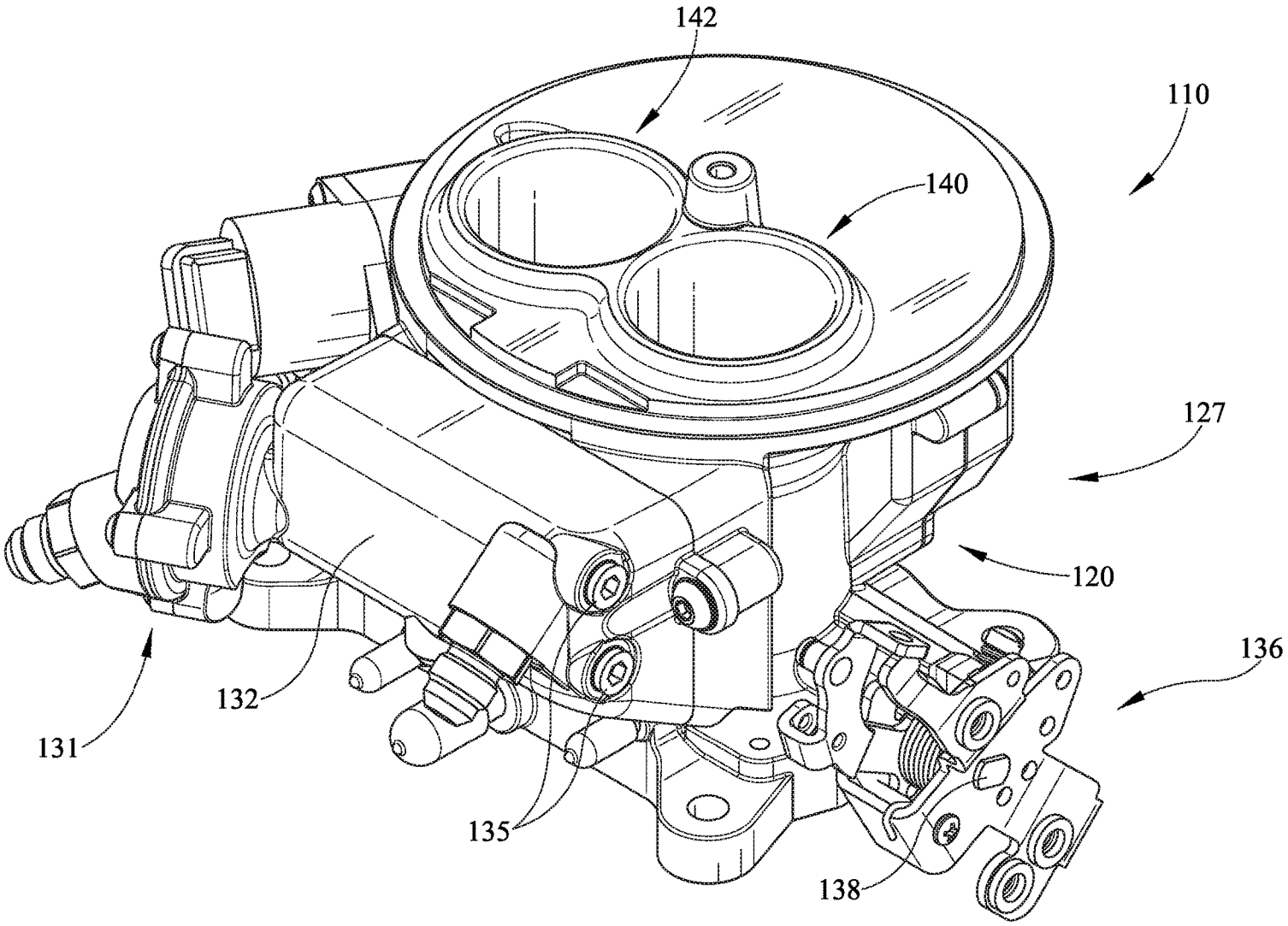
FIG. 4 is a second upper front perspective view of the electronic fuel injection throttle body assembly.

Referring now to FIG. 4, an alternate front perspective view is shown depicting the side 127 of the throttle body assembly 110. The throttle lever assembly 136 is shown which comprises a throttle shaft 138 extending through the throttle body 120 and bores 140, 142. A plate 139 (FIG. 9) is connected to the shaft 138 in each bore 140, 142, in order to open and close the bore to airflow. Also shown at the lower side 129 of the assembly 110 is a throttle lever assembly 136. The assembly 136 is in communication with a mechanical linkage for example, which causes movement of the lever assembly 136 and specifically a shaft 138 connected to the lever assembly 136. With rotation of the shaft 138, valve plates 139 (FIG. 9) located within the at least one bore 140 may rotate based on fuel/air demand. At the opposite side of the throttle body 120, from the lever assembly 136 may be a throttle position sensor 195 (FIG. 2) which provides communication to the electronic control unit 190 concealed by the cover 130. In the instant embodiment, the throttle lever assembly 136 is provided on a single side of the throttle body assembly 110. This inhibits interference of moving parts with other non-moving parts such as wires. This also make easier the wire routing process, so that only one area has to be avoided.

Also shown in FIG. 4 are plugs 135 which are associated with flow passageways within the cover 132. Each plug 135 may be utilized to provide fuel flow to the passages within the cover 132, as an alternative to the inlet 144. Thus, fuel may be provided to the upper fuel injectors or the lower fuel injectors, independently, before moving to the regulator, generally indicated at regulator cover 131. The plugs 135 provide for auxiliary fuel inlet locations to the passages 160, 164 (FIGS. 5, 6), which may be desirable depending on the engine configuration and fuel line location. For example, a fuel supply line may be split with a Y or T style adapter and directed into the inlets defined at the plugs 135.

Advantageously, fuel may be supplied from an external source to the top fuel passage or bottom fuel passage through the corresponding plugs 135. For example if an engine uses a dropped base air cleaner, fuel may be supplied to the bottom fuel passage (bottom plug 135) for additional clearance. Conversely, if there are space constraints near the base 122 of the throttle body 120, for instance plumbing for a nitrous system or the like, then fuel may be supplied to a top fuel passage by the top plug 135. As discussed below, in one embodiment, different fuels or fluids may be supplied simultaneously to the top and bottom fuel passages. The fuel passages may be sized the same as an external supply hose that connects with the system to optimize fuel flow to the one or more fuel injectors.

Figure 5:
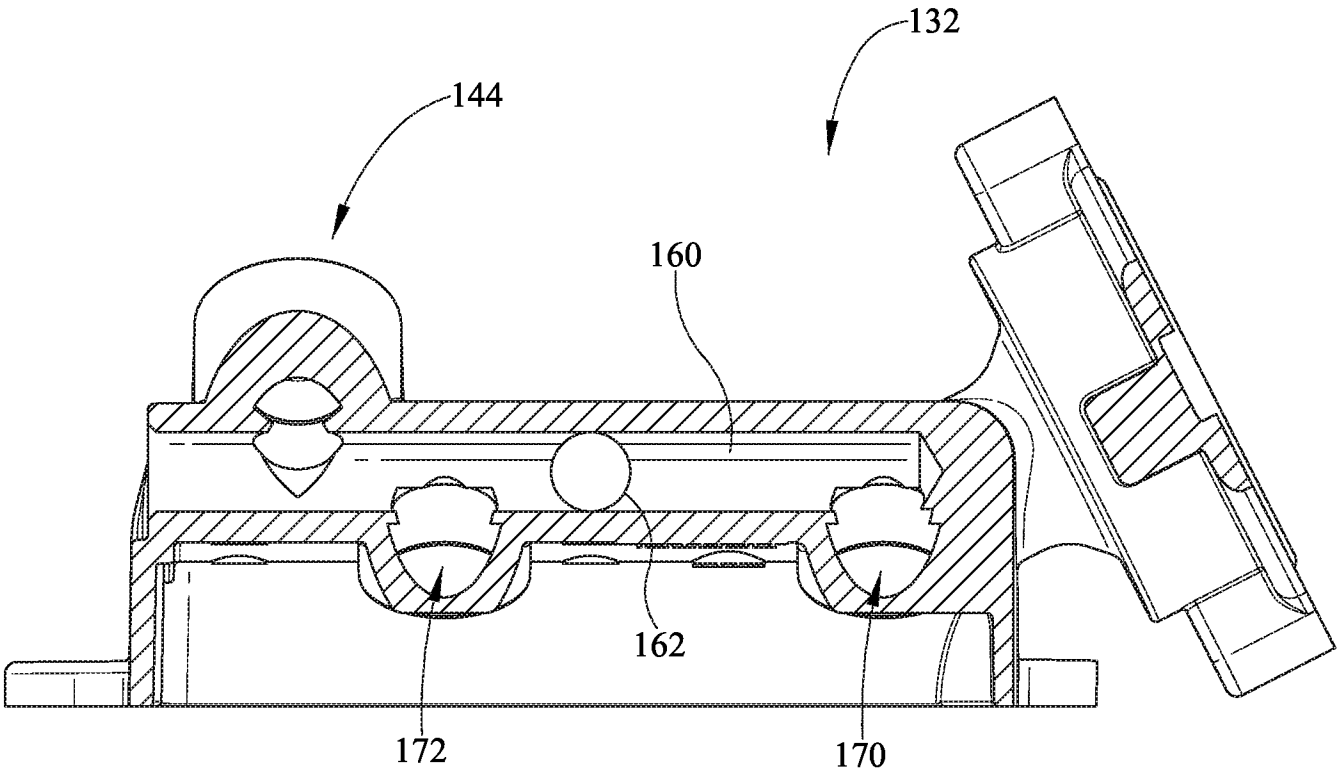
FIG. 5 is a sectional view of the fuel component cover depicting an internal area.

Referring now to FIG. 5, a section view of the fuel component cover 132 is shown, removed from the throttle body 120 (FIG. 4). The section view depicts a fuel passage 160 which is in fluid communication with the fuel inlet 144. The passage 160 is generally horizontal when the fuel component cover 132 is mounted to the throttle body 120. The passage 160 delivers fuel to the upper fuel injector ports 170, 172.

Figure 6:
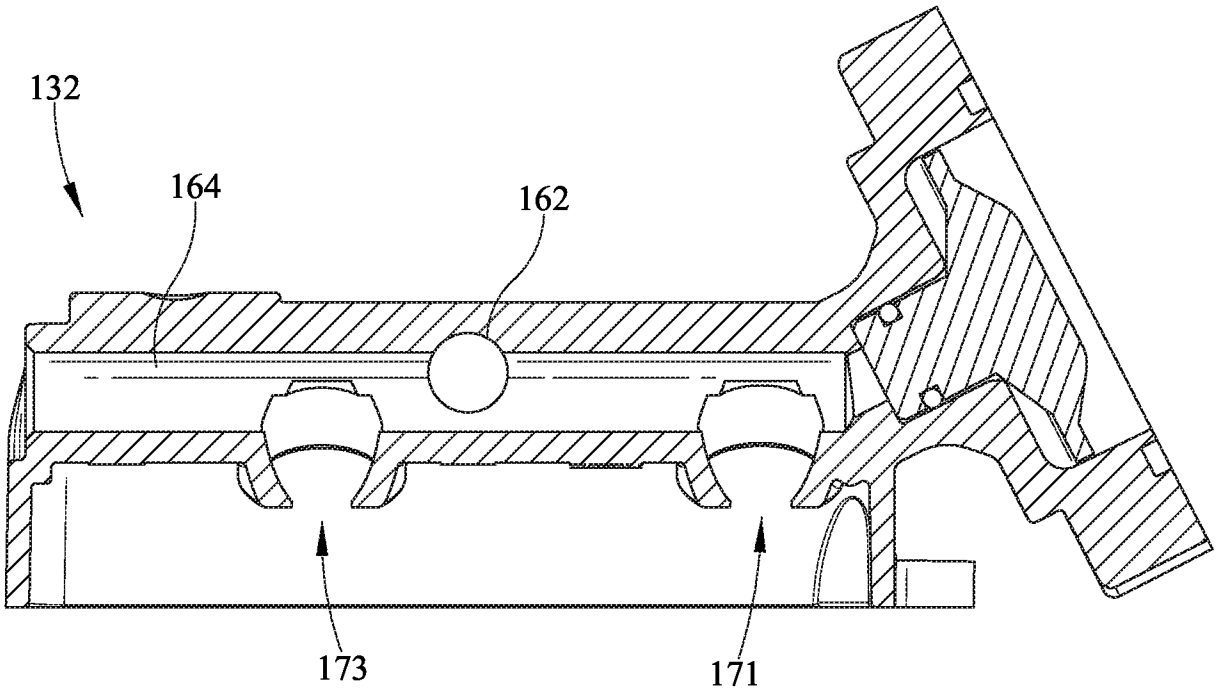
FIG. 6 is a section view of the fuel component cover depicting a second internal area.

Also disposed along the passage is a connecting passage 162 which extends to second elevation, relative to the first passage 160, and a second passage 164 (FIG. 6). The second passage 164 may be utilized if there are two ports and fuel injectors per bore 140, 142. Further, while the instant embodiment may be configured as an upper first passage and lower second passage 164, the present embodiments may be configured to provide fuel to the lower passage with the upper passage being optional, if second injectors are utilized.

Referring now to FIG. 6, a second sectional view of the cover 132 is shown. In this view, the second passage 164 is shown in communication with connecting passage 162. Further, the passage 164 is also shown in fluid communication with the ports 171, 173. At an end of the passage 164, the regulator cover 131 and regulator 133 therein are shown in fluid communication with the passage 164.

Figure 7:
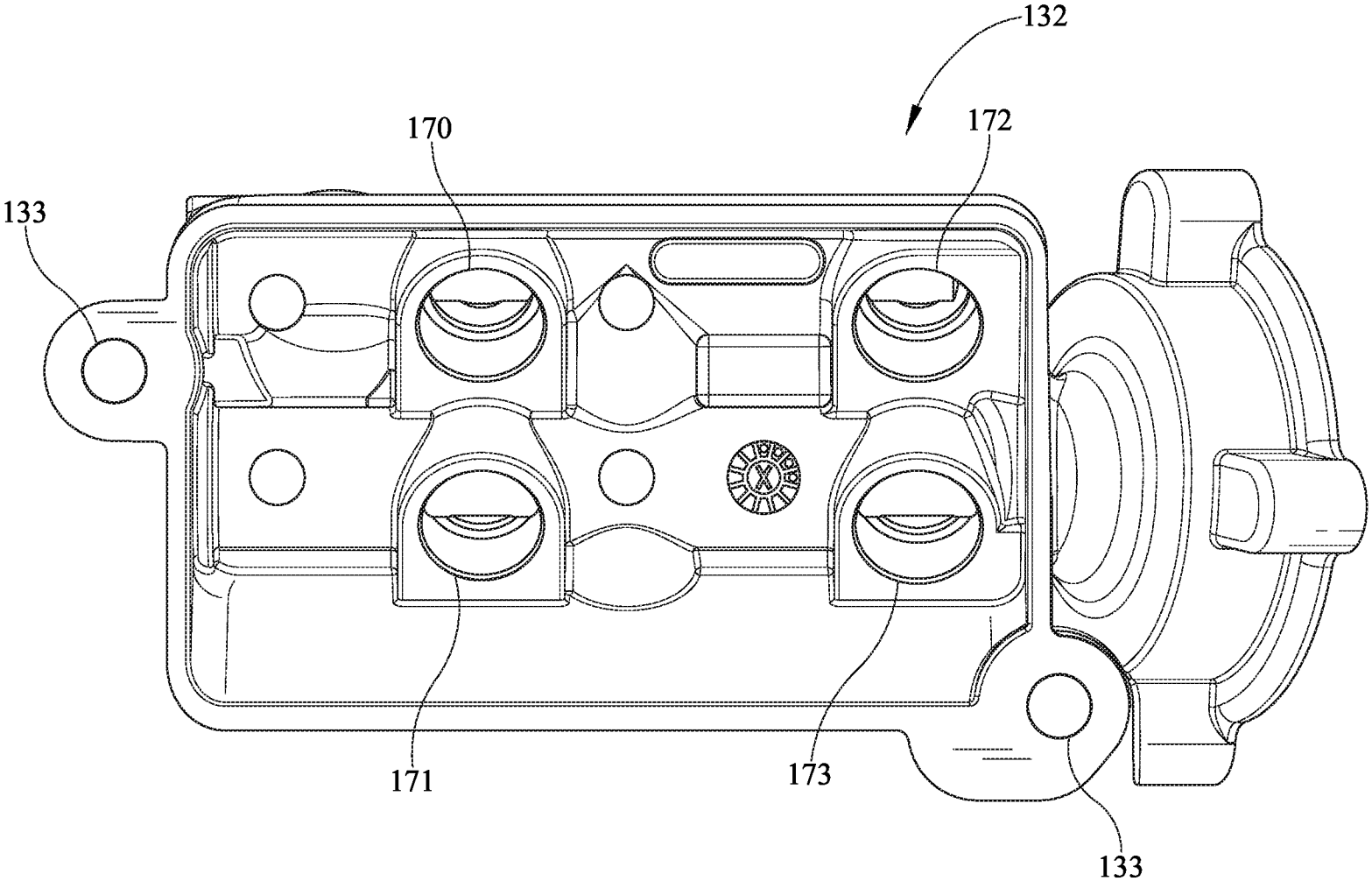
FIG. 7 is an interior view of the fuel component cover.

Referring still further to FIG. 7, an interior view of the fuel component cover 132 is shown. The ports 170, 172 and 171, 173 are shown which cover corresponding ports in the throttle body 120 (FIG. 4). Generally, the ports 170-173 may be considered individually defined in the cover 132 and the throttle body 120 or alternatively may be considered as formed in whole by the assembly of the cover 132 to the throttle body 120. In either event the fuel injectors 1171, 1173 may be fully enclosed or partially enclosed by the assembly of the cover 132 to the throttle body 120.

The ports 170-173 are aligned with the bores 140, 142 in both vertical and horizontal directions. That is, the ports 170, 171 are vertically aligned and ports 172, 173 are aligned vertically. As previously described, it is possible to use either a single fuel injector per bore or two injectors per bore. In the situation where a single injector is used in each bore, the upper or the lower ports may be used depending upon which passage 160, 162 (FIG. 5) is utilized.

In combination with FIGS. 5-7, the passages 160, 164 may be discussed. In addition to being parallel, the passages 160, 164 may be aligned vertically or may be offset from one another. The vertical relationship of the passages 160, 164 may be dependent upon the external shape of the cover 132 and the location of the injectors.

Figure 8:
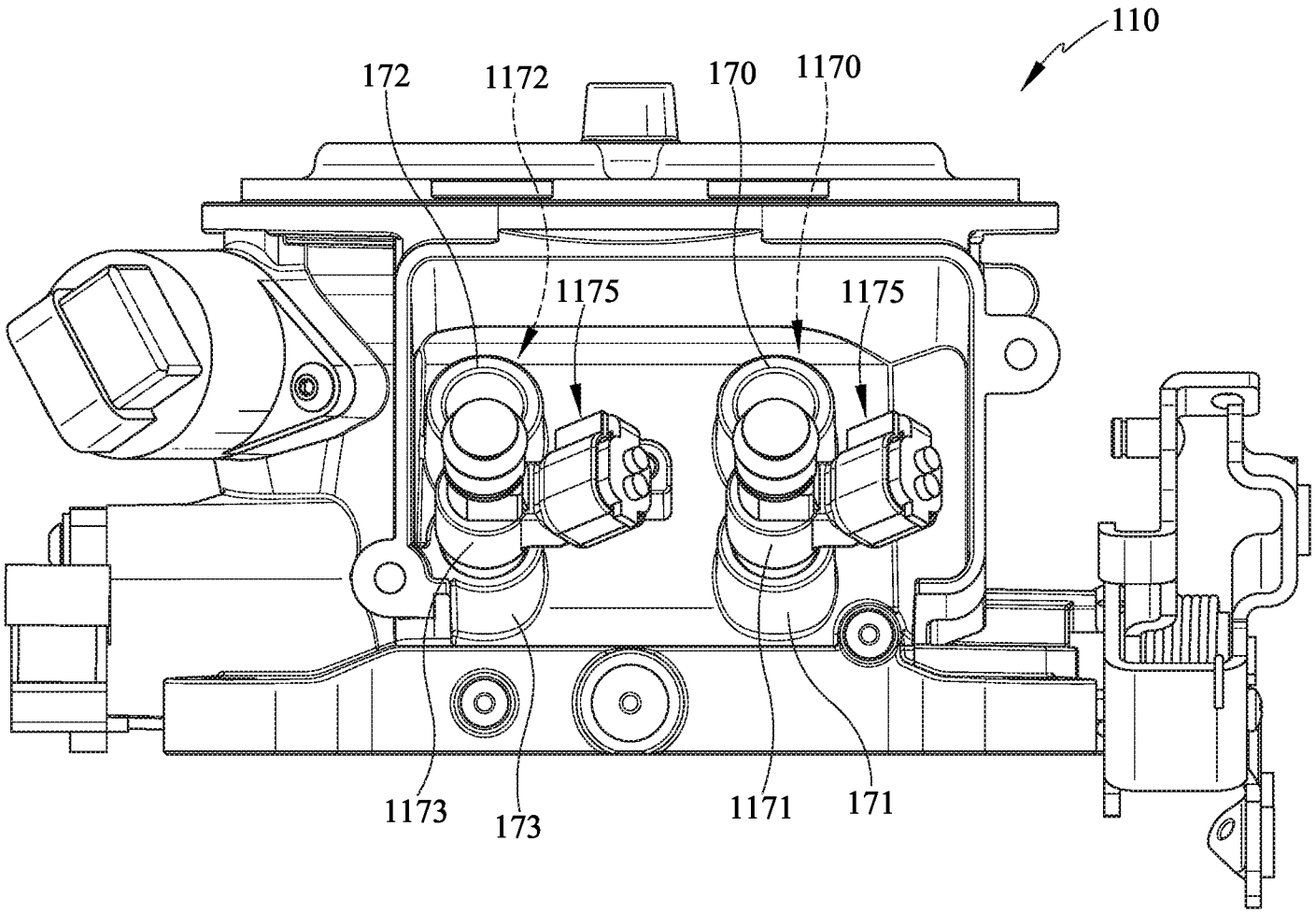
FIG. 8 is a front view of the electronic fuel injection throttle body assembly with a fuel component cover removed depicting the positioning of the fuel injectors according to one embodiment.

Referring now to FIG. 8, a front view of the throttle body assembly 110 is shown with a fuel component cover 132 removed. The fuel injectors 1171 and 1173 are shown extending from the ports 171, 173. The fuel injectors 1171, 1173 may be oriented in various manners and according to some embodiments are oriented in a downward direction into the bores 140, 142 (FIG. 4).

Figure 11:
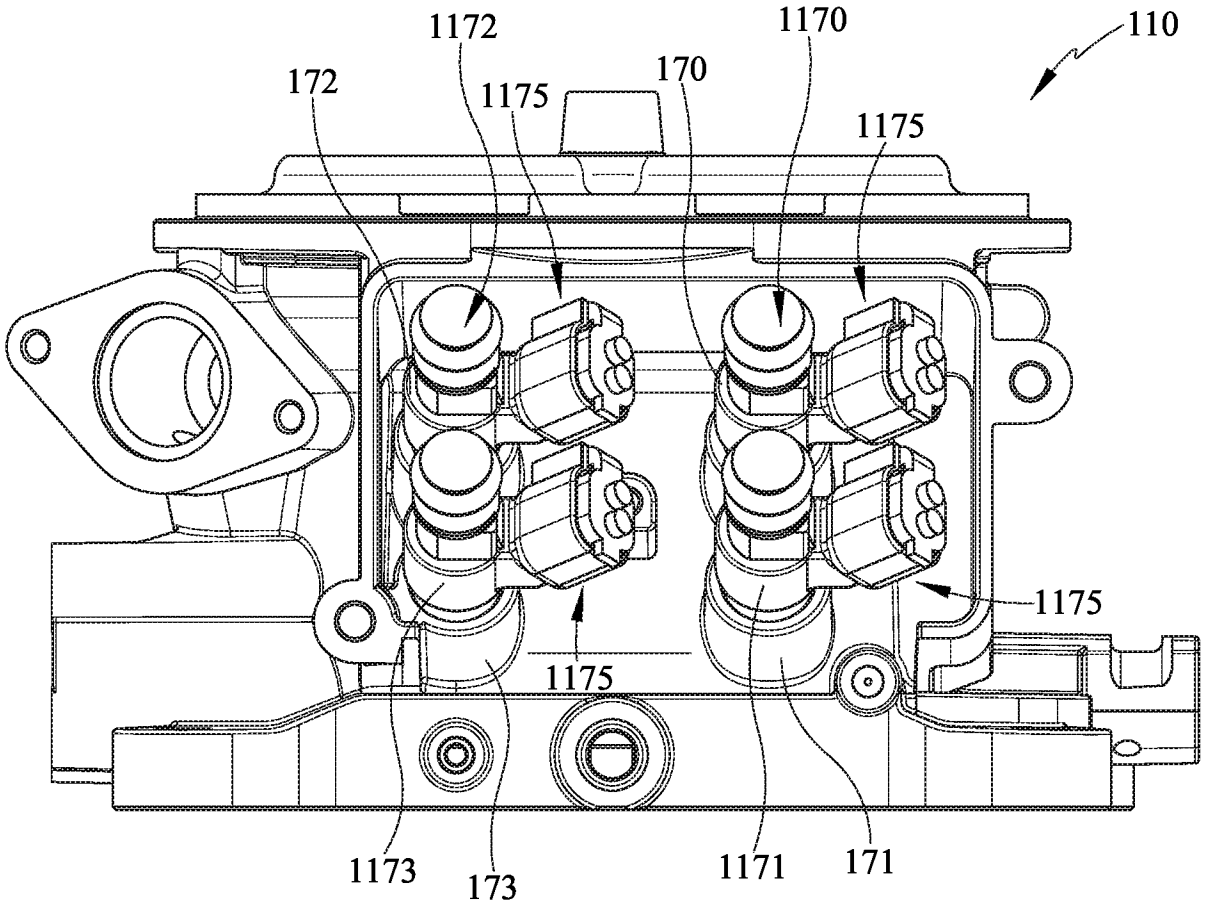
FIG. 11 is a side view of the throttle body assembly of FIG. 10 including fuel injectors.

In this embodiment, there is a single fuel injector per bore. Further, the fuel injectors are located in the lower ports 171, 173. In this embodiment, therefore, the passage 164 (FIG. 6) provides fuel to the fuel injectors. However, in other embodiments, the single injectors per bore may be located in upper ports 170, 172 and be fed fuel from passage 160 (FIG. 5). Still further, where there are two ports per bore, two injectors per bore may be utilized, for a total of four injectors 1170-1173 (FIG. 11).

With reference now to FIG. 9, a section view of the throttle body assembly 110 is provided. The section is taken through a fuel injector 1171 and port 171. In this view, the angled downward orientation of the fuel injector 1171 is shown. Also, above the port 171 and injector 1171, is a blank port 170. The port 170 may be cast with the throttle body 120, but may require additional machining for use. Alternatively, the upper port 170 may be used and if an additional injector is desired for a bore, such lower port may be machined.

Also shown in this view is an illustrative bore 142. The bore 142 has a single fuel injector port 171 with injector 1171. The injector 1171 delivers fuel as directed by the electronic control unit 190 to the bore 142. A similar arrangement may be used for injector 1170 at port 170. The bore 142 includes apertures 175 through which the fuel passes to a fuel ring or sleeve 152. The ring or sleeve 152 is generally cylindrical in shape and has hollowed interior with open ends. The ring or sleeve 152 seals the hole 175 so that fuel is directed through a channel extending about the outer surface of the ring 152 and through apertures 155, into the bore 142. The ring or sleeve 152 in combination with the inner diameter of the bores 142 form the channel wherein fuel passes to a plurality of apertures 155 located in the rings 152. The plurality of the fuel apertures 155 which deliver fuel into the inner surface of the ring 152 and into the interior of the bore 140, radially inward of the ring 152. The apertures 155 direct fuel downward and in a radial direction into the center of the ring 152 and bore 140. While a single ring 152 is shown, in embodiments where two injectors per bore are utilized, it may be desirable to use two rings which are disposed within the bore 142. Alternatively, a larger ring of longer axial length may be utilized. Further, as shown in FIG. 11, when stacked injectors are used, a second optional ring 252 in the bore may also be utilized as indicated in broken line.

With reference still to FIG. 9, a fuel injector alignment direction is also shown. The fuel injector alignment direction is considered to be a direction between first and second ends of the fuel injector, purely in a horizontal plane. In these views, the fuel injector alignment direction is shown as generally perpendicular to the shaft 138. Also, it should be understood that the fuel injector alignment direction is generally horizontal regardless of whether the fuel injector is horizontal, oriented upwardly toward the bores 140 or oriented downwardly toward the bores as shown.

The fuel injector 1170 is also shown in this view. Each of the fuel injector ports 170-173, may have an injector such as injector 1171 (shown) located therein. The injectors direct fuel into the bores 140, 142, by way of the at least one ring 152, for mixture with air moving into the bores. Each of the injectors 1170-1173 receives fuel as a first end from the fuel passages in the cover 132 and injects fuel from the second end into the bore 140, via aperture 175.

Below the ring 152, the throttle shaft 138 and the valve plate 139 are shown. The shaft 138 is shown with the plate 139 disposed thereon in the bore 142. The shaft 138 is slabbed or cut to have a flat area wherein the plate 139 may be seated and fastened. The fasteners are shown fastening from below as this eases installation, however this is merely illustrative and non-limiting. When the throttle lever assembly 136 causes rotation of the shaft 138, the plate 139 rotates therewith to open or close the bore, depending on the action of the driver.

FIG. 9 also shows a portion of the electronic control unit 190 electronic control unit cover 130. The cover 130 is connected to the throttle body 120, for example by fasteners or otherwise removably connected. The electronic control unit 190 may be a printed circuit board, and may further comprise memory to which operating code may be flashed. The electronic control unit 190 may be connected to the cover 130 for example by one or more fasteners and may also be potted to reduce effects of contaminants, water, noise, vibration or other environmental influences. Alternatively, the electronic control unit 190 may be connected to the throttle body 120 and then covered by the cover 130. The electronic control unit 190 or "controller" is used herein generally to describe various apparatus relating to the monitoring of engine data, user input and the performance of one or more actions in response to occurrence of certain engine sensor data or action from user. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may also include a printed circuit board and may be implemented with or without employing a processor, and also may be implemented as a combination of dedicated hardware to perform some functions and a processor (e.g., one or more programmed microprocessors and associated circuitry) to perform other functions. Examples of controller components that may be employed in various implementations include, but are not limited to, conventional microprocessors, application specific integrated circuits (ASICs), and field-programmable gate arrays (FPGAs).

In various implementations, a processor or controller may be associated with one or more storage media (generically referred to herein as "memory" e.g., volatile and non-volatile computer memory such as RAM, PROM, EPROM, and EEPROM, floppy disks, compact disks, optical disks, magnetic tape, etc.). In some implementations, the memory may be encoded with one or more programs that, when executed by the controller, perform at least some of the functions discussed herein. Memory may be fixed within a processor or controller or may be transportable, such that the one or more programs stored thereon can be loaded into a processor or controller so as to implement various aspects of implementations disclosed herein.

Also shown within the cavity between the cover 130 and the throttle body 120, is an intake air temperature (IAT) sensor 192. The IAT sensor 192 is operably connected to the electronic control unit 190, either by wired connection or by plug on the printed circuit board. The IAT sensor 192 extends through a hole in the throttle body toward the bore 140. The IAT sensor 192 does not extend through bore 140 and therefore does not substantively alter airflow characteristics of air moving through the bore 140. An o-ring or other sealing feature may be used with the IAT sensor 192 to inhibit moisture from entering the cavity along the IAT 192 wherein the ECU 190 is located. The IAT 192 is internal and integrated with the ECU 190, again for ease of installation by the end user, and with less likelihood of damage to the IAT 192.

Figure 10:
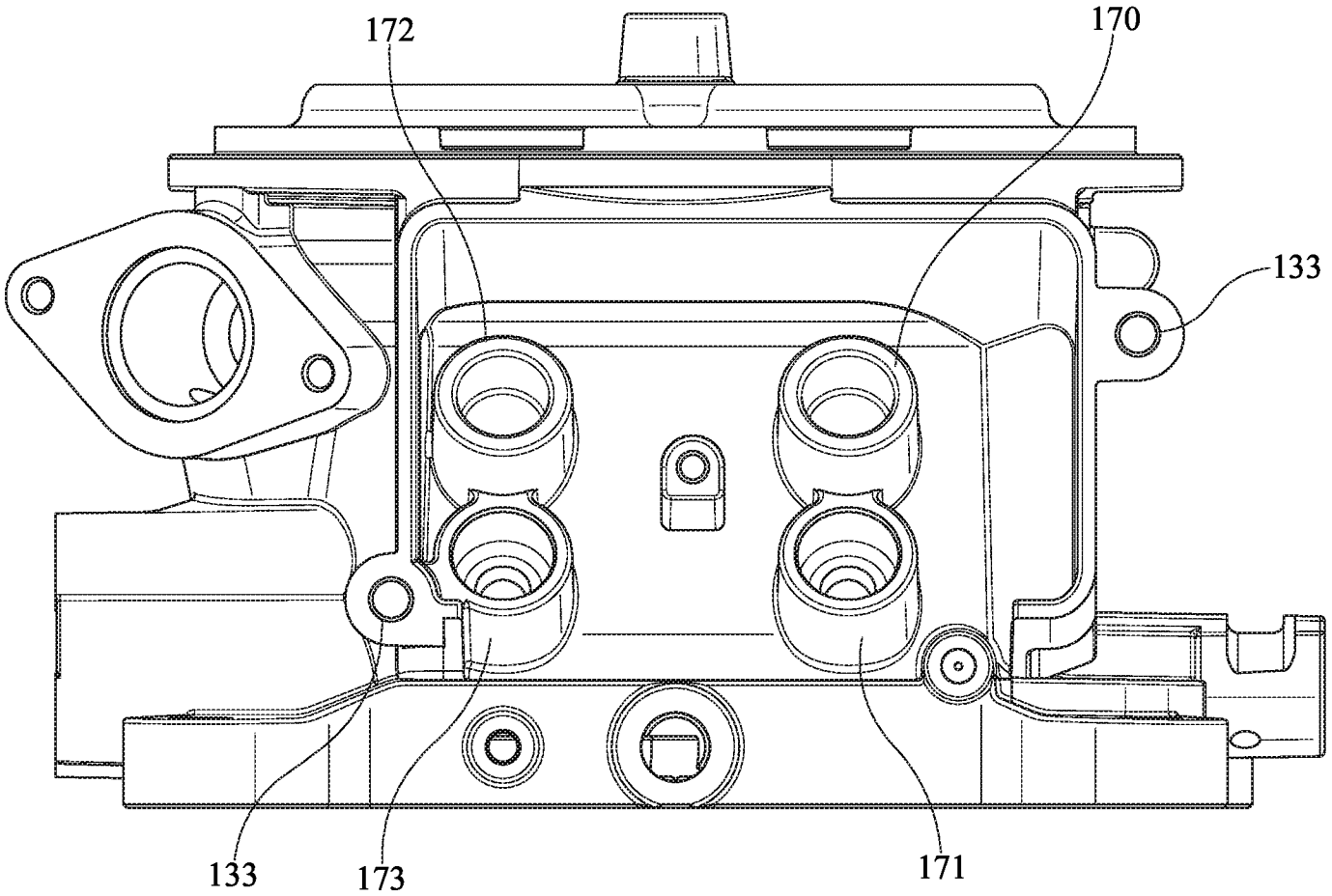
FIG. 10 is side view of the throttle body assembly with the fuel component cover removed.

Referring now to FIG. 10, a front view of an alternative embodiment is shown with the fuel component cover 132 removed. In this embodiment, the throttle body 120 has four ports, two per bore. Accordingly, there are shown ports 170-173 which all for positioning of four injectors. Further for purpose of clarification, the fuel injectors are removed for some clarity of the description. In this embodiment, the ports are vertically aligned within bores 140, 142 and horizontally for flow communications with passages in the fuel component cover 132.

With reference still to the embodiments of FIGS. 8-10, the stacked arrangement of fuel injection ports 170, 171, 172, 173. The ports are arranged vertically and stacked directly on top of one another. The pair of vertical ports 170, 171 are aligned with a centerline of the bores 142 such that the fuel injectors 1170 are also aligned with the center lines of the respective bores 142, for example. The ports are shown angled downwardly relative to the throttle body 120. In other embodiments, the angle may be varied to be horizontal or upward and the firing angle of the fuel may be at the center of the bores 140, 142 or alternatively, off center.

Still further, with reference to FIGS. 8-11, the views show the distinction between the fuel injection ports 170-173 and the corresponding injectors. In FIGS. 8 and 10, the ports are all empty of injectors, however FIGS. 9 and 11 includes injector 1171, which are shown in one of the two ports shown. The injectors 1171 (and others which are not shown) are inserted based on size of the engine and/or performance requirements. When larger engines are utilized and higher horsepower is required, more injectors may be desirable. Practically speaking, and merely for non-limiting example, the throttle body 120 may be cast for example with two ports per each of bores 140, 142 in the stacked vertical arrangement already described. During subsequent manufacturing, depending on the need for one injector or two injectors per bore, the additional bore injector may be machined to accept an injector. Thus, for example, the upper or lower ports of each of bores 140, 142 may be machined to receive an injector after casting, but if a cast throttle body will be manufactured into a two ports per bore assembly, the other port of each bore may be machined so that it may also accept a fuel injector.

As an alternative, rather than not machining all of the cast ports of each bore, all of the ports could be machined but the unused ports could be closed with a plug. In future use, an end user or a manufacturer could subsequently unplug any plugged ports for use of additional fuel injectors.

Still further, FIGS. 7, 10 also show corresponding fastener locations 133 in the throttle body 120 and the fuel component cover, 132. The fastening locations 133 on either of the throttle body 120 and the cover 132 are offset from one another in vertical directions. That is, a horizontal line extending right to left, or vice versa, through each of the fastener holes are parallel rather than aligned. This offset is beneficial to prevent any twisting of the component covers.

Referring now to FIG. 11 a view of the alternate embodiment having stacked injectors is shown. As noted previously, there may be two injectors per bore. When such embodiment is utilized, the additional upper or lower port is utilized to position the additional injector. Thus, the injectors 1170-1173 are all shown in this embodiment. The injectors 1170, 1171 are shown vertically aligned relative to one bore. Further, the injectors 1172, 1173 are also shown aligned relative to the second bore. With brief additional reference to FIG. 9, when the second injectors (per bore) are utilized, a second ring 252 may be used. The second ring 252 is shown in broken line as it is optionally utilized when tow injectors per bore are configured. However, it is further within the scope of the present embodiments and claims that the upper ring be used and the lower ring be the optionally utilized ring. The second ring 252 includes a plurality of fuel apertures 255 therein.

Extending from the injectors 1170 are wired connectors 1175 and wires which extend to the electronic control unit 190. The connectors 1175 connects to a connector which is in electrical communication with the injector 1170. Through this wired connection with the electronic control unit 190, the injectors 1170-1173 may be directed to inject fuel by the ECU 190. The remainder of the wires are hidden by the component cover 132 and routed behind the cover where possible.

Figure 12:
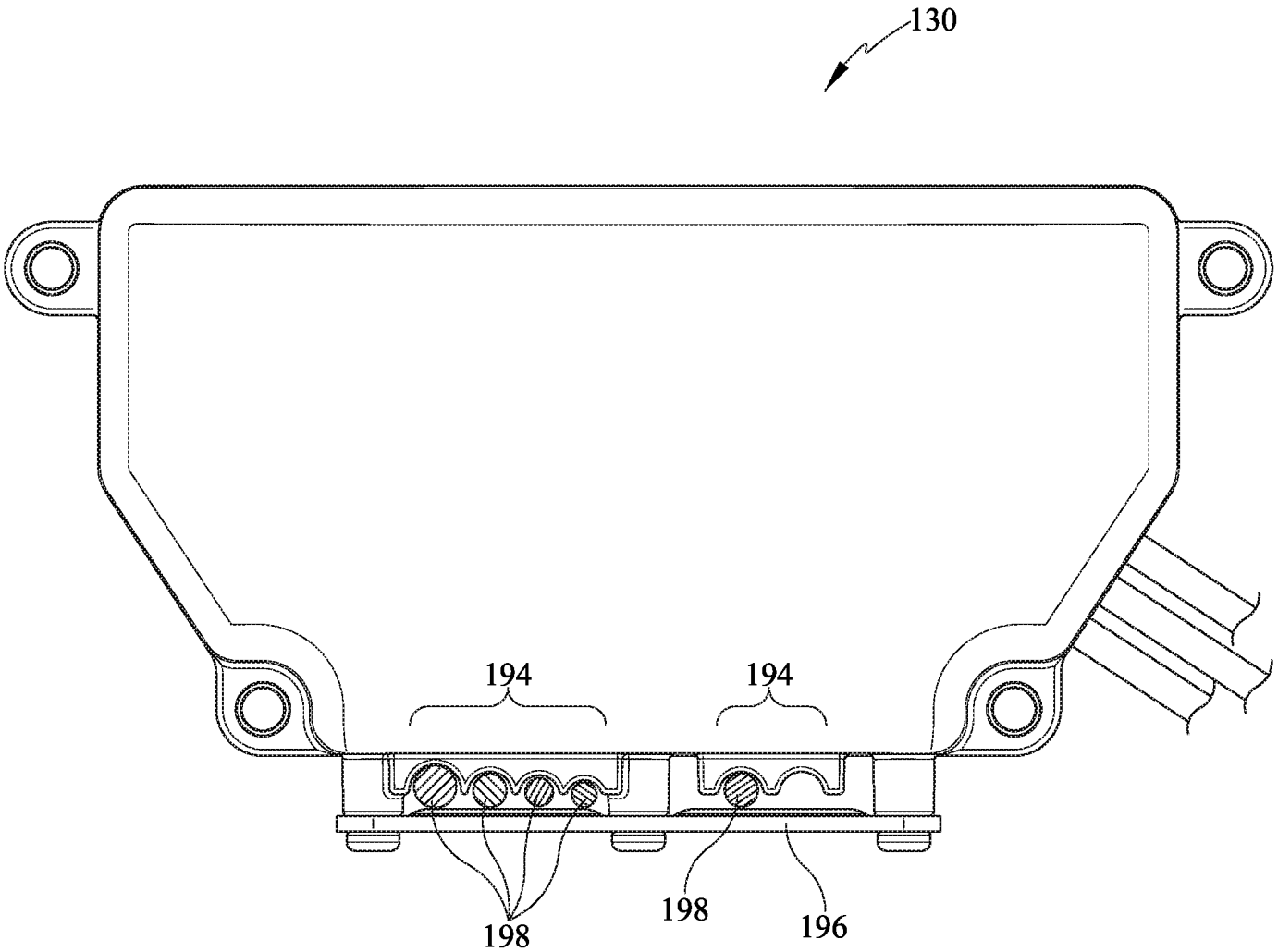
FIG. 12 is a front view of the electronic control unit cover.

Referring now to FIG. 12, the ECU cover 130 is shown in front view. Along a lower edge of the cover 130 are strain reliefs 194. The strain reliefs 194 allow for wiring to exit from within the cover 130 and be routed about the throttle body 120 to various components providing service to or from the ECU cover 130. The strain reliefs 194 may be of same size or may be of differing sizes to accommodate differing gauges of wire.

In combination with FIGS. 2 and 12, the wires 198, 199 routing may be discussed. Beneath the strain reliefs 194 are is at least one strap 196. The strap 186 retains the wires 198 against the strain reliefs preventing damage to the wire at the ECU or disconnection from the ECU. The strap 196 is shown fastened to the cover 130, but various type of connections may be utilized. The strain reliefs 194 may be completely filled or may be partially utilized as shown. Further the wires 198, 199 may also be embodied by cable, each cable having multiple wires or conductors therein.

Also, shown in FIG. 2 is a notch 197 is formed in the throttle body 120 to define a wire routing pathway from the ECU 190. In FIG. 12, the wires 199 are shown extending from the notch 197 (FIG. 2). The application of the cover 130 on to the throttle body 120, forms a strain relief in combination with the notch 197. The wires 199 are therefore inhibited from being pulled from the ECU 190 (FIG. 9) or otherwise damaged.

The wires 198, 199 may be routed in various manners but according to some embodiment, may be routed away from the throttle lever assembly 136 which has moving parts. Thus, the wires may be run along the opposite side of the throttle body assembly 110.

One advantage of the instant embodiments is that the electronic control unit (ECU) 190 is provided on the throttle body 120. One group of wires 198, 199 extend to the injectors 1171-1173 of the injector ports 170, 171, 172, 173, etc., from the ECU 190 while other wires may extend to other electronic components. For example, the wires may communicate and/or power an IAC motor 193 (FIG. 3), a throttle position sensor 195 (FIG. 2), wiring harnesses, coolant temperature sensor and/or a handheld display or other devices/functionalities. With numerous wires required, it is desirable to manage wiring extending about the throttle body assembly 110 so as to inhibit contact with moving parts of the throttle body assembly 110 and the other moving parts within the engine. With brief reference to FIGS. 8 and 11, also shown are the connectors 1175 which are connected by wire to the ECU 190 (FIG. 12) and for communication between the ECU 190 the electronic fuel injectors 1170 (FIG. 13).

Figure 13:
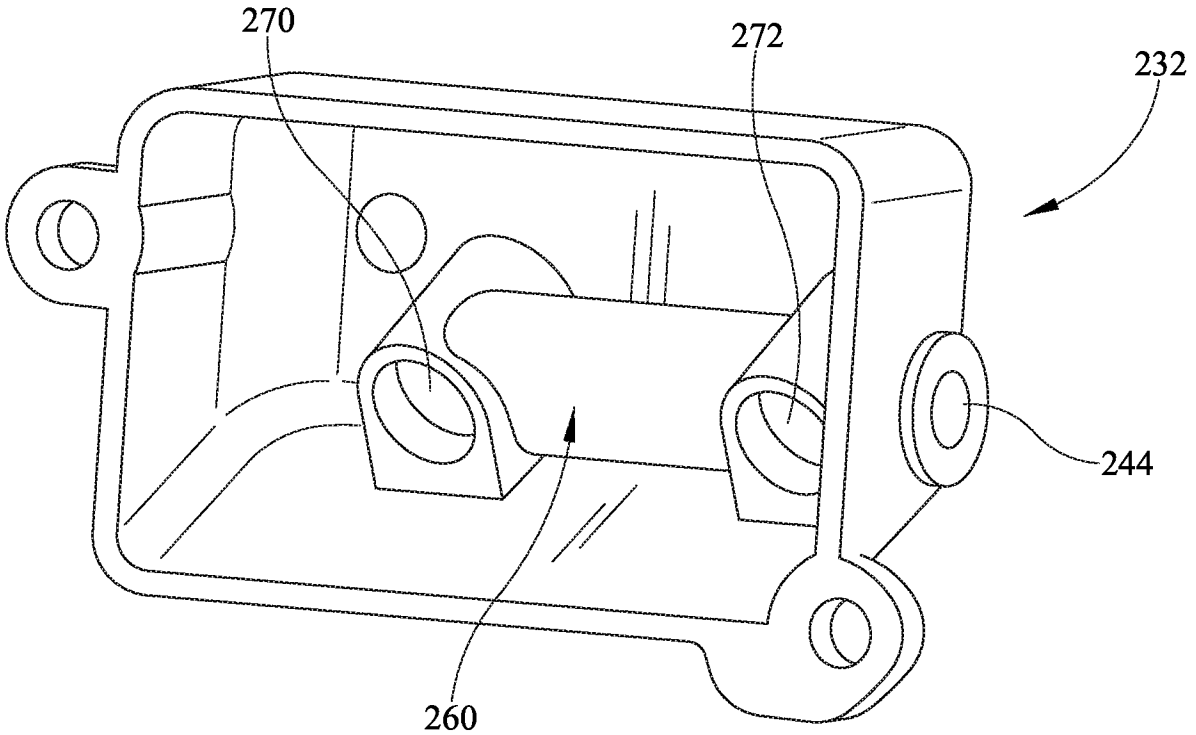
FIG. 13 is an internal perspective view of an alternate fuel component cover.

Referring to FIG. 13, a further embodiment is provided for the fuel component cover 232. In this embodiment, an orientation of the fuel inlet 244 is changed and enters the fuel component cover 232 in a horizontal direction. Movement of the inlet 244 from a front of the fuel component cover as in the earlier embodiment to the side may allow for multiple throttle body assemblies to be used in a stacked arrangement for an engine. When this stacked arrangement is used, the throttle bodies may be rotated about a vertical axis to properly fit the throttle bodies on the engine. Further as shown from the depicted view, there is only a single passage 260 in flow communication with the fuel inlet 244. The passage 262 is in flow communication with two ports 270, 272 which each may receive a portion of the fuel injectors in order to provide fluid communication to the bores.

Further, one skilled in the art will realize that the fuel component cover 232 does not also comprise an additional fuel outlet and regulator cover. Advantageously, the instant fuel component cover 232 provides that the regulator (and regulator cover) may be removed. This may be desirable if for example the regulator operates at a fixed, preselected value, but an end user would like a different operating pressure. In order to do so, the regulator cover are not needed. As a result, when the regulator is removed, an alternate external regulator may be utilized. For example, this embodiment may be used with an exterior regulator upstream of the fuel component cover 232.

The modularity or interchangeability of parts (like a fuel component cover 132, 232) allows different fuel flow paths and configurations. This provides maximum flexibility to build variations of interchangeable parts that differ in size, fuel capacity, etc.

With this in mind, it may be desirable to provide modular features for the throttle body assembly to meet any number or combination of these desired characteristics and/or applications. For example, the position and number of fuel injectors may vary. As described previously, various number of injector ports may be cast or formed, but not all used in each application. Further, to deliver fuel to the fuel injectors, the fuel component covers may also be formed to deliver fuel to upper, lower or both elevation fuel injectors depending on the applications requirements.

One skilled in the art should now understand that the electronic fuel injection throttle body assembly 110 also comprises modular applications. By defining many common mounting points and features for the various throttle body subassemblies such as fuel component covers, main bodies, electronic control units, rings and injectors, interchangeability is increased which allows engineers to mix and match the subassemblies to create new throttle body assemblies for new applications.

These new applications may be desired to increase airflow, fuel capacity, fuel inlet/outlet plumbing configurations and mounting locations of various subcomponents to clear other external obstacles (such as air cleaner assemblies). These different applications may be further defined by characteristics such as engine size or configuration, which includes throttle bore number, size, orientation or mounting interface. The applications and characteristics may, in turn, dictate the size, number and placement and potentially concealment of the fuel injectors (if employed), the placement of the ECU (if employed) as well as the inclusion of an internal and/or integral fuel pressure regulator.

Further, the throttle body 120 may also be machined to be used as an air valve only. That is, no injector ports, no fuel routed through the assembly. In this embodiment, separate fuel component covers function to provide wire/cable retention and concealment covers, providing same mounting pattern as fuel component covers 132, 232.

Still further, regardless of injector configuration, the modular throttle body 120 may be machined in a fashion such that the electronic control unit 190 may or may not be mounted on the throttle body 120. Alternatively, the ECU may be mounted in the cover 130, or still further may be located remotely with a blank cover mounted on the throttle body 120.

Interchangeability of components also lends itself in the multiple assembly application front to back on an existing intake manifold. This may for example be a 3×2 or a multi-throttle body installation directly or indirectly mounted to an engine.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teaching(s) is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of methods and embodiments of the invention has been presented for purposes of illustration. It is not intended to be exhaustive or to limit the claims to the precise steps and/or forms disclosed, and obviously many modifications and variations are possible in light of the above teaching. It is intended that the scope of the embodiments and all equivalents be defined by the claims appended hereto.

What is claimed is:

1. A throttle body assembly, comprising:

a body having a first bore and a second bore extending downwardly on a side of a body centerline;

a fuel component cover having an inlet, said inlet disposed at an angle to a horizontal;

said body having at least a first fuel injector port formed at each of said first and second bores;

said body having at least a second fuel injector port cast at each of said first and second bores and configured for machining to render a retaining area usable, said first fuel injector port being parallel to said second fuel injector port;

said fuel component cover disposed over said first fuel injector port and said second fuel injector port;

a valve plate disposed within each of said first and second bores, each of said valve plate disposed on a throttle shaft; and, said first and second fuel injector ports having a horizontal alignment direction which is perpendicular to said throttle shaft.

2. The throttle body assembly of claim 1 further wherein said throttle shaft is extending through said body in a direction perpendicular to a horizontal direction of said first fuel injector port.

3. The throttle body assembly of claim 1, further comprising a fuel injector in each of said first and second fuel injector ports.

4. The throttle body assembly of claim 3 further comprising a fuel regulator disposed on said fuel component cover.

5. The throttle body assembly of claim 4 further comprising an outlet in fluid communication with said fuel regulator.

6. The throttle body assembly of claim 5, said outlet being angled relative to a horizontal direction.

7. The throttle body assembly of claim 1 wherein said fuel component cover has parallel horizontal passages which are one of vertically aligned or offset.

8. The throttle body assembly of claim 1 further comprising a fuel outlet on said fuel component cover.

9. The throttle body assembly of claim 1 further comprising a regulator housing formed with said fuel component cover.

10. The throttle body assembly of claim 9, further comprising said regulator cover clockably connected to said fuel component cover.

11. The throttle body assembly of claim 1, further comprising an electronic control unit disposed on a side of said body opposite said fuel component cover.

12. A throttle body assembly, comprising:

a body having a first bore and a second bore both extending downwardly on a side of a body centerline;

at least one first fuel injector port formed in each of said first and second bores;

at least one second fuel injector port formed in each of said first and second bores;

a fuel component cover having an inlet passage in flow communication;

a vertical passage allowing flow communication to a second passage, said second passage capable of providing fuel flow to said second fuel injector port when said second fuel injector port is configured for use;

a valve plate disposed in each bore; and, a throttle shaft extending through said body and engaging each of said valve plate, said throttle shaft extending in a direction which is substantially perpendicular to a fuel injector horizontal alignment direction.

13. The throttle body assembly of claim 12 further comprising an electronic control unit disposed on a side of said body opposite said fuel component cover.

14. The throttle body assembly of claim 13 further comprising a plurality of strain reliefs along a lower edge of an electronic control unit cover.

15. The throttle body assembly of claim 12 further comprising a fuel outlet.

16. The throttle body assembly of claim 15, further comprising a fuel inlet and said fuel outlet both being disposed on a single side of said body.

17. The throttle body assembly of claim 12 said at least one first and second fuel injector ports being angled relative to a horizontal direction.

18. The throttle body assembly of claim 12 wherein said fuel flow enters said fuel component cover at an angle to a horizontal direction and travels in said horizontal direction.

19. The throttle body assembly of claim 18, wherein said fuel flows in one of a vertical or an angled direction through said fuel component cover to change elevation.

20. A throttle body assembly, comprising:

a body having a first bore and a second bore both extending downwardly on a side of a body centerline;

at least one first fuel injector port formed in each of said first and second bores;

at least one second fuel injector port formed in each of said first and second bores;

a fuel component cover having an inlet passage in flow communication;

a vertical passage allowing flow communication to a second passage, said second passage capable of providing fuel flow to said second fuel injector port when configured for use;

a valve plate disposed in each bore;

a throttle shaft extending through said body and engaging each of said valve plate, said throttle shaft extending in a direction which is perpendicular to a fuel injector horizontal alignment direction;

an electronic control unit disposed on a side of said body opposite said fuel component cover.

* * * * *